US011320151B2

(12) United States Patent
Helm

(10) Patent No.: US 11,320,151 B2
(45) Date of Patent: May 3, 2022

(54) METHOD FOR SELF-TESTING AND CHECKING CERTAIN FUNCTIONS OF A COOKING APPLIANCE, AND COOKING APPLIANCE FOR CARRYING OUT SAID METHOD

(71) Applicant: MKN Maschinenfabrik Kurt Neubauer GmbH & Co. KG, Wolfenbuettel (DE)

(72) Inventor: Peter Helm, Wolfenbuettel (DE)

(73) Assignee: MKN Maschinenfabrik Kurt Neubauer GmbH & Co. KG

( * ) Notice: Subject to any disclaimer, the term of this patent is extended or adjusted under 35 U.S.C. 154(b) by 512 days.

(21) Appl. No.: 15/029,153

(22) PCT Filed: Oct. 14, 2014

(86) PCT No.: PCT/EP2014/071945
§ 371 (c)(1),
(2) Date: Apr. 13, 2016

(87) PCT Pub. No.: WO2015/055606
PCT Pub. Date: Apr. 23, 2015

(65) Prior Publication Data

US 2016/0270579 A1 Sep. 22, 2016

(30) Foreign Application Priority Data

Oct. 14, 2013 (EP) ..... 13188594

(51) Int. Cl.
*A47J 27/62* (2006.01)
*F24C 7/08* (2006.01)

(52) U.S. Cl.
CPC ..... *F24C 7/085* (2013.01)

(58) Field of Classification Search
CPC ..... A47J 27/62; F24C 7/085
See application file for complete search history.

(56) References Cited

U.S. PATENT DOCUMENTS 4,155,293 A * 5/1979 Spiel ..... A23L 5/13 99/352
4,924,072 A * 5/1990 Oslin ..... A47J 27/04 219/400

(Continued)

FOREIGN PATENT DOCUMENTS

EP 2213946 8/2010
EP 2327934 6/2011

(Continued)

*Primary Examiner* — Steven N Leff

(74) *Attorney, Agent, or Firm* — Jansson Munger McKinley & Kirby Ltd.

(57) ABSTRACT

A method for self-testing and checking certain functions of a cooking appliance in the form of a convection oven, a steamer, or a combination of the two, namely, a convection steamer, which comprises a cooking chamber or compartment, which can be closed by a cooking compartment door, a plurality of actuators such as pumps, at least one heating device, at least one steam injection/generating device, at least one flow-generating device such as a blower, and flaps and/or valves as well as temperature sensors and an appliance control unit. The temperature sensors of the cooking appliance and the functionality of the actuators of the cooking appliance can be checked in that the detected temperatures and temperature profiles are compared with the reference temperature values or reference temperature profiles which are to be expected during operation of the actuator in question, and which are stored in the electronic appliance control unit.

12 Claims, 8 Drawing Sheets

(56) References Cited

U.S. PATENT DOCUMENTS

| | | | | |
|---|---|---|---|---|
| 6,146,678 | A * | 11/2000 | Caridis | A21B 1/245<br>426/510 |
| 2012/0103966 | A1 * | 5/2012 | Gladhill | H05B 1/0263<br>219/391 |

FOREIGN PATENT DOCUMENTS

| | | |
|---|---|---|
| EP | 2604929 | 6/2013 |
| WO | 1997/03538 | 1/1997 |
| WO | 2002/01917 | 1/2002 |

* cited by examiner

METHOD FOR SELF-TESTING AND CHECKING CERTAIN FUNCTIONS OF A COOKING APPLIANCE, AND COOKING APPLIANCE FOR CARRYING OUT SAID METHOD

CROSS-REFERENCE TO RELATED APPLICATION

The present application is a U.S. national phase entry of pending International Patent Application No. PCT/EP2014/071945, international filing date Oct. 14, 2014, which claims priority to European Patent Application No. EP 13 188 594.9, filed Oct. 14, 2013, the contents of which are incorporated by reference in their entireties.

FIELD OF THE INVENTION

The present invention pertains to a method for self-testing and checking certain functions of a cooking device in the form of a convection oven, a steamer, or a combination of the two, namely a convection steamer, which comprises a cooking chamber or compartment, which can be closed by a cooking compartment door, and a plurality of actuators such as pumps, at least one heating device, at least one steam injection device, at least one flow-generating device such as a blower, and flaps and/or valves as well as temperature sensors and an appliance control unit.

BACKGROUND OF THE INVENTION

Modern cooking appliances are highly sophisticated devices with a large number of individual components, some of which are subject to a certain amount of wear as a result of the frequent loads to which they are subjected; these loads have multiple causes, one of which is the high temperatures at which the device operates. A large number of malfunctions can therefore occur, which make it more difficult or even impossible to obtain the desired cooking result.

It is possible in principle to monitor certain appliance functions by means of complicated sensors. Thus, for example, the operation of the blower wheel can be monitored by appropriate monitoring of the blower motor by the use of Hall sensors, for example. The operation of pumps such as the drain pump can be monitored by using pressure sensors, for example, or by measuring the flow rate, or by measuring the current drawn by the pump. The sensors and control units required for this purpose are disadvantageous. Not only are they complicated and thus expensive, but the sensors themselves are also at risk of malfunction and failure, so that it cannot always determined whether the assembly responsible for the appliance function is itself defective or whether it is the monitoring sensor which is defective.

In particular, problems can also occur in the context of customer service visits, specifically in low-density population areas. The major problem is often that, because the operating personnel are becoming increasingly less knowledgeable, the appliance defect in question can no longer be identified, and when the call goes out to customer service, the customer cannot tell the service representative what spare parts he should bring with him When the customer service representative then arrives and is obliged to observe that he does not have the required spare part, he must often make an extra trip back and forth, often over quite a long distance.

An object of the present invention is therefore to propose a self-testing method which does not require additional sensors to check the functioning of the actuators of the cooking appliance, and which, after the test has been run automatically, makes it possible to determine whether any of the actuators is defective, and, if so, which one(s), so that effective maintenance procedures can be carried out and/or certain actuator malfunctions can be determined or ruled out. This object is achieved by the features of claim 1.

SUMMARY OF THE INVENTION

The method according to the invention for self-testing and checking certain functions of a cooking appliance in the form of a convection oven, a steamer, or a combination of the two, namely a convection steamer, is characterized in that, by means of the temperature sensors of the cooking appliance, the functionality of the actuators of the cooking appliance can be checked by comparing the detected temperatures and temperature profiles with the reference temperature values and reference temperature profiles which are to be expected during operation of the actuator in question and which are stored in the electronic appliance control unit; and in that, if the detected value agrees with the corresponding reference value, the electronic appliance control unit concludes that the actuator in question is functioning properly, or, if a deviation is detected, that it is malfunctioning and displays, stores, and/or transmits the results for evaluation, wherein, at the beginning of each detection, the cooking appliance is in a defined initial state.

By means of the temperature measurements, which can be conducted by the temperature sensors installed in the cooking appliance, certain actuators are checked to determine their functionality. A basic principle of the self-testing method according to the invention is the evaluation of certain rates of temperature change. The evaluation is dependent on, for example, the size of the cooking appliance, on the type of energy and voltage, or on the type of gas. There are therefore certain limit values associated with the specific appliance. As a result of the temperature measurements, therefore, appliance defects can be confirmed or ruled out. By isolating the malfunction of the cooking appliance and identifying the individual components responsible, it is possible in particular to improve customer service efficiency.

Thus, within the scope of the present invention, all essential appliance components can be checked in the simplest possible way. The great advantage of the present invention also consists in that, to implement the self-testing, no additional sensors need to be installed in the cooking appliance; on the contrary, the temperature sensors necessary for the cooking programs in question and for the operation of the cooking appliance are themselves sufficient to carry out the various individual self-testing steps.

It is advantageous, furthermore, for at least two actuators to be checked in succession, and for the defined starting state of the at least second actuator test to be produced essentially by the preceding actuator test. Thus several actuators can be self-tested one after the other in correspondingly rapid sequence.

It can be provided, if desired, that the following actuator cannot be tested if the preceding actuator has failed its test, in which case the entire test procedure thus comes to a stop. This prevents false test results from being obtained, and there is no danger that a properly operating actuator is judged to be defective.

It is especially advantageous, furthermore, for the self-test to comprise a check of the oven/steamer compartment environment (temperature/humidity) control and/or the cleaning of the cooking appliance. This can be done either in different self-tests or in a one complete self-test.

Within the scope of the self-test, it is advantageous for it to be possible to check at least one of the following actuators of the cooking appliance: the heating device, the temperature controller, the steam generation, the dehumidifier, the recirculation pump, and drain pump for draining a liquid reservoir.

It is advantageous to determine the functionality of the heating device by heating the cooking compartment over a specific temperature range within a predetermined time interval.

In the case of cooking appliances with direct water injection, it is advantageous to determine the functionality of the steam generation by heating the cooking compartment to a predetermined temperature and then to detect the drop in temperature during the active steam generation. The steam generation test can thus be carried out immediately after the test of the heating device. In the case of cooking appliances which comprise an additional steam generator, the test can be carried out by detecting the increase in the temperature of the cold cooking compartment caused by the injection of 100° C. steam.

It is advantageous, furthermore, to determine the functionality of the dehumidification by a dehumidifier by heating the cooking compartment and then, after opening the dehumidifier, to detect the temperature measured by a sensor thermally coupled to the dehumidifier, preferably a sensor in a feed air pipe, which temperature should drop by a predetermined amount within a predetermined time interval. As a function of the appliance in question, it may be possible to use the cooking compartment temperature sensor for this test, if it is sufficiently well-coupled thermally to the dehumidifier. Dehumidification can be achieved by supplying outside air or by injecting water, i.e., by quenching the steam atmosphere.

It is advantageous, furthermore, to determine the functionality of the recirculation pump by heating the cooking compartment and, after activating the recirculation pump, by detecting the cooking compartment temperature, which should fall by a predetermined amount in a predetermined time interval. Thus here is no longer any need to detect the operation of the recirculation pump directly by means of appropriate sensors, as described above.

It is advantageous, furthermore, to determine the functionality of the drain pump by first filling the liquid reservoir and starting the recirculation pump, then by turning the drain pump on and heating the cooking appliance in convection mode. A temperature considerably greater than 100° C. should be measured after a predetermined time interval. The relationships are as follows: While the recirculation pump is running, the cooking compartment is cooled by the water being continuously pumped through the cooking compartment. As long as this circuit is operating, the temperature in the cooking compartment cannot rise much above 100° C. even at the maximum heat setting.

This water circuit is interrupted when a properly functioning drain pump is turned on. The liquid reservoir of the recirculation pump is emptied. The recirculation pump runs on empty and cannot pump any water into the cooking compartment. Without this supply of water, the cooking compartment can now heat up to the set nominal temperature of greater than 100° C.

It is advantageous, furthermore, for the self-testing method according to the invention to determine whether the door seal is providing a satisfactory sealing effect; this can be done by first heating the cooking compartment to a predetermined temperature and then, after making sure that the door is closed, turning off the heating device and the actuators and detecting the temperature drop. If the door seal is completely functional, the temperature will drop only slightly, whereas, if the door seal is defective, a correspondingly greater temperature drop will be detected.

The present invention is not limited to the situation in which an operating cooking appliance can be tested for functionality by the self-testing method according to the invention. The self-testing method according to the invention is also adapted, according to the invention, to the self-testing of a new appliance. This facilitates the final inspection of the new appliance before delivery to the intended customer. In addition, a calibration of the reference values can be carried out under standardized conditions when they are stored for the first time.

In particular, it is advantageous, according to the present invention, for the detected values to be stored in a values table for later checking Deviations can then be identified accordingly on the basis of this values table.

The method according to the invention can be advantageously initiated by a wired or a wireless connection to the cooking device.

It is a particular advantage of the present invention that the individual self-tests run essentially automatically, and that their results are automatically displayed and possibly transmitted and/or stored as data.

It is preferable to conduct the test during the night, when the cooking appliance is not being used. The user can also be instructed to perform the necessary preparations such as not to leave any cooking racks in the cooking compartment at the end of work on the preceding day.

The present invention also comprises a cooking appliance in the form of a convection oven, a steamer, or a combination of the two, namely, a convection steamer, with a cooking compartment, which can be closed by a cooking compartment door, and a plurality of actuators such as pumps, at least one heating device, at least one steam injection/generation device, at least one flow-generating device, and flaps and/or valves as well as temperature sensors and an electronic appliance control unit, wherein this cooking appliance is adapted to, and capable of, performing a self-testing method according to one of claims 1-14.

BRIEF DESCRIPTION OF THE DRAWINGS

Additional details, features, and advantages of the present invention can be derived from the following description of the exemplary embodiments illustrated in the attached drawings.

DETAILED DESCRIPTION OF PREFERRED EMBODIMENTS

Figure 1:
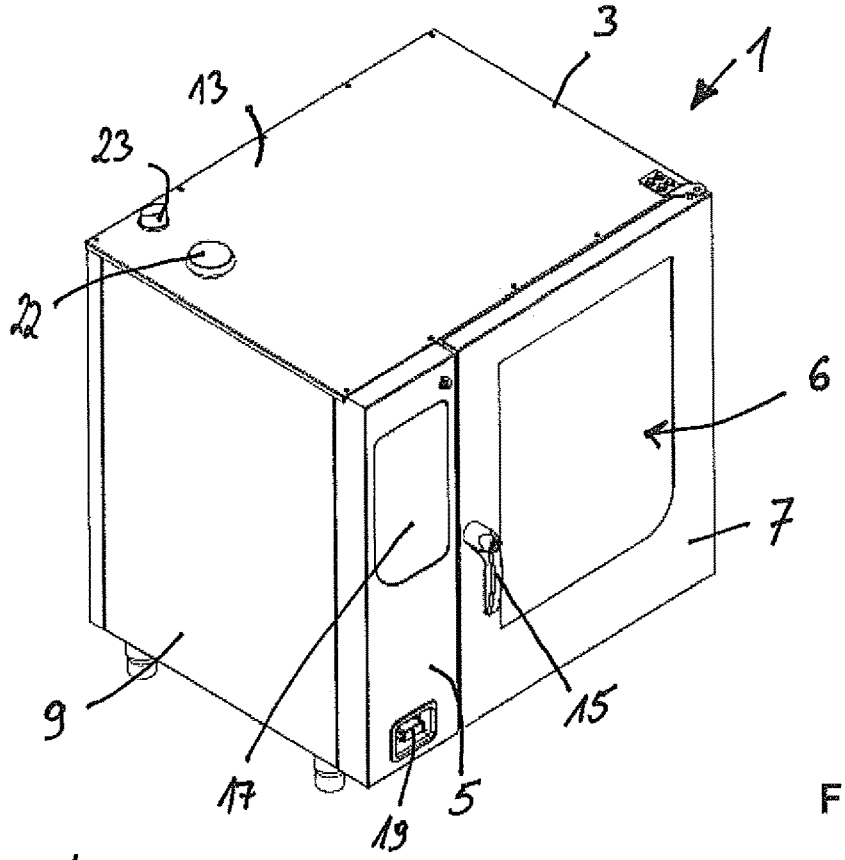
FIG. 1 shows a perspective view of a cooking appliance, which is adapted to the performance of the method according to the invention.
Figure 2:
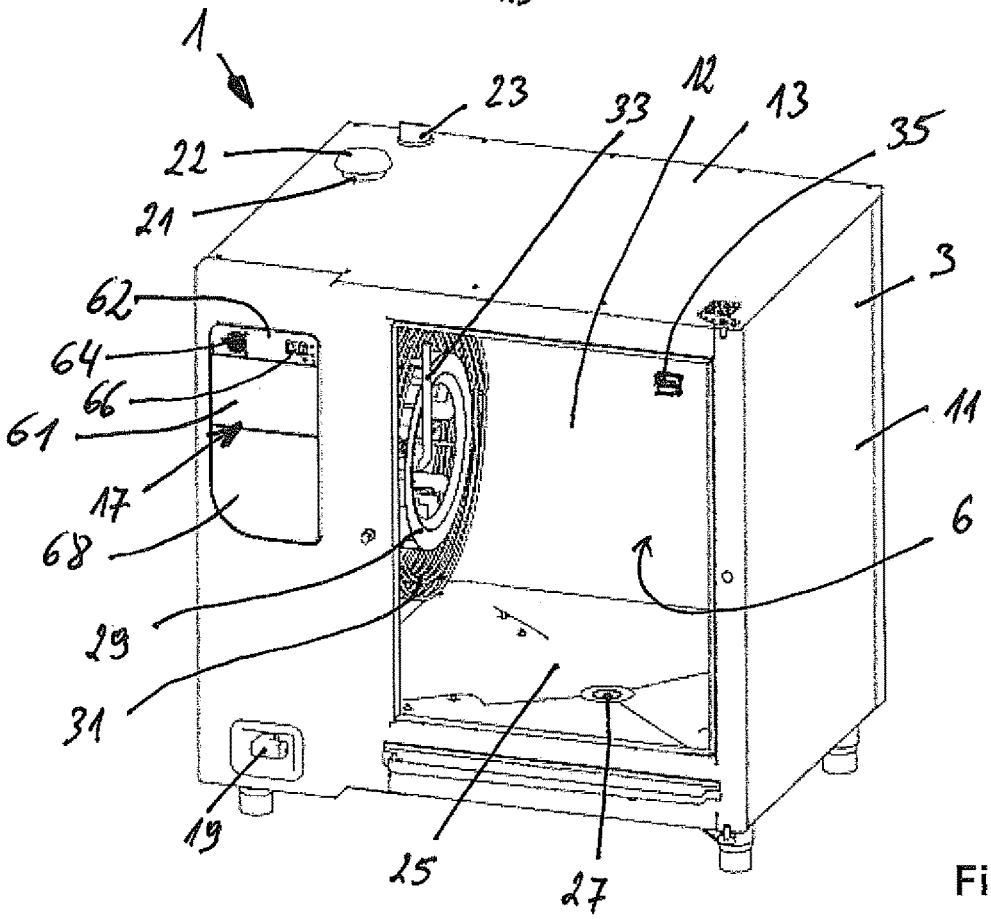
FIG. 2 shows another perspective view of the cooking appliance of FIG. 1 with the cooking compartment door removed.

FIGS. 1 and 2 show perspective views of a cooking appliance 1 in the form of a convection steamer, which is adapted to the performance of the method according to the invention. Cooking appliance 1 comprises a housing 3 with a front cover wall 5 and a cooking chamber or compartment 6, which is closed by a cooking compartment door 7 and through which, after it has been opened, the cooking compartment is accessible. Cooking appliance 1 also comprises a left side wall 9, a right side wall 11 (FIG. 2), and a top 13. A door handle 15 is provided to open and close cooking compartment door 7.

In front cover wall 5 there is a display and control panel 17, which is configured in the form of a touchscreen. An input signal to the appliance control unit can be transmitted by direct contact with certain fields.

The subdivision of the display and control panel 17 is illustrated in more detail in FIG. 2. The display and control panel 17 comprises two different sub-display and operating panels. A rectangular touchscreen 61 is provided, which can be touched to enter a selection, wherein the appliance control unit will, in response, display the appropriate additional touchscreens to make the following inputs possible and to display the state of the cooking appliance associated with that state. As a result, the cooking appliance 1 can be easily controlled by the user.

Above the touchscreen 61 there is provided a panel 62 with a single row, on the left of which a loudspeaker 64 is provided, which is covered by a decorative foil and therefore cannot be seen on the appliance. On the right is provided an on/off button 66 for the cooking appliance 1, preferably also touch-sensitive. Under the touchscreen 61 another decorative surface 68 is provided, which, if desired, can also be configured as an additional display and control panel.

For the sake of clarity, the cooking compartment door has been removed in FIG. 2, so that cooking compartment 6 can be seen more easily. Interior fittings such as air baffles and support racks have also been removed. Cooking compartment 6 is bounded by a rear wall 12 at the back and also has a cooking compartment floor 25. In cooking compartment floor 25 a drain opening 27 is provided, through which liquid and quenched steam or vapors can be conducted away. The liquid is conducted to a reservoir (not shown) underneath cooking compartment floor 25. On rear wall 12 a temperature sensor 35 is provided, which detects the temperature in cooking compartment 6.

As can be seen in FIG. 2, cooking appliance 1 comprises a blower wheel 29, which is surrounded by a heating device 31. The embodiment of the cooking appliance according to FIGS. 1 and 2 shows a "direct" steam generating system, in which water is supplied to the interior of blower wheel 29 through a pipe 33, said water is distributed by blower wheel 29, and is thrown onto heating device 31, where the water evaporates. The method can also be implemented, of course, in cooking appliances in which the steam is generated separately, i.e., outside cooking compartment 6, and introduced into cooking compartment 6 for the steaming treatment.

Figure 3:
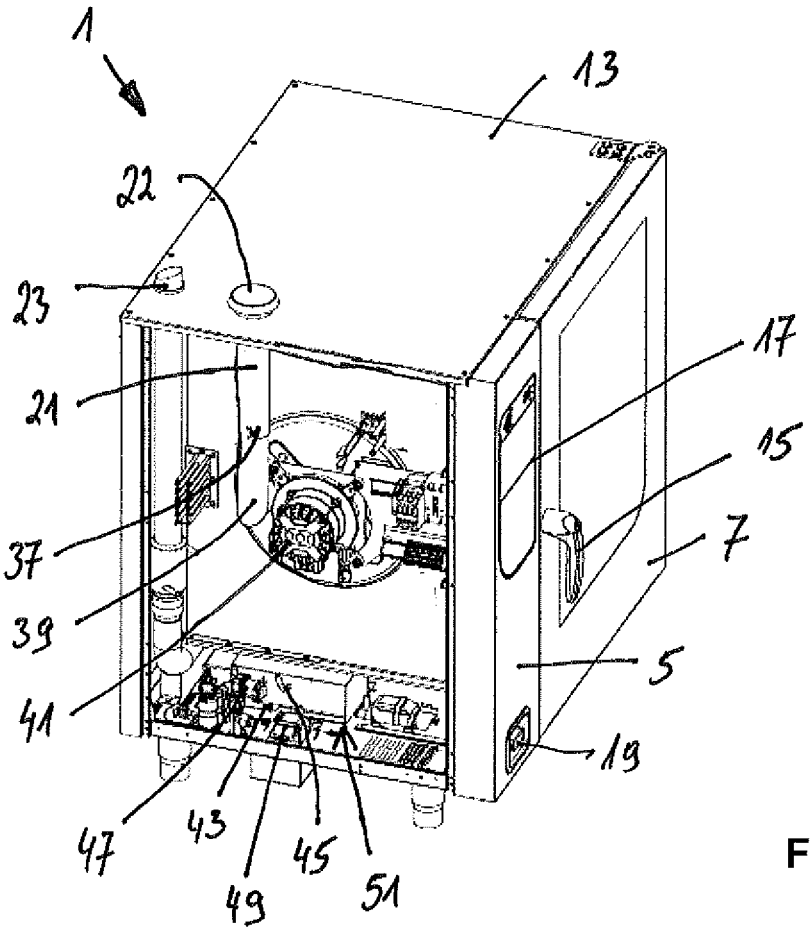
FIG. 3 shows another perspective view of the cooking appliance of FIG. 1 with the left side wall removed, thus providing a view of the so-called "technical space" behind the display and control panel.

FIG. 3 shows a perspective view directed at the left side of cooking appliance 1; the left side wall has been opened or removed, so that it is easier to see the so-called "technical space". This space contains not only the appliance control unit and other elements, which are not described in detail because they are conventional, but also an exhaust pipe 23, through which air or vapors can be conducted directly out of cooking compartment 6. Cooking appliance 1 comprises a dehumidifying device, which comprises a feed air pipe 21, which projects upward out of top wall 13 and is covered by a cap 22 to prevent undesired liquid or solid particles from entering feed air pipe 21. Feed air pipe 21 has an extension in the form of a feed air pipe section 39, which leads into cooking compartment 6. In feed air pipe 21 there is a feed air flap 37, which can be controlled and which adjusts the amount of feed air entering the compartment.

Blower wheel 29 is driven by a blower wheel motor 41, the speed and direction of which can be controlled.

In the lower area of the technical space a vapors temperature sensor 43 and a pipe 45 for quenching the vapors are provided. A vapors quenching valve 47 is present, which is connected to the vapors quenching pipe 45 by a hose (not shown).

A recirculation pump 49 and a drain pump ("siphon pump") 51 are also provided. The recirculation pump serves to circulate cleaning liquid, whereas drain pump 51 serves to empty the liquid reservoir (not shown), located underneath the cooking compartment.

In the following, the individual components of the self-testing method according to the invention are described. The starting point of the self-testing method is a defined initial state of the cooking appliance, i.e., the state which is present when the self-testing method is begun.

Figure 19:
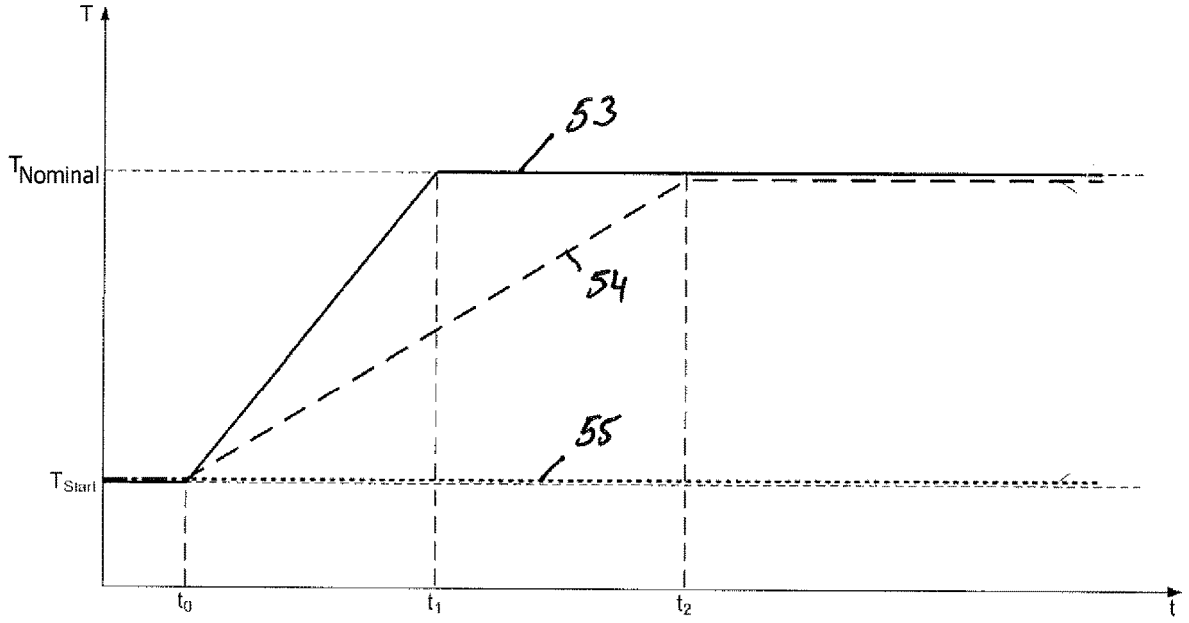
FIG. 19 shows an idealized graph of the time-dependent change in temperature during a heating phase along three different temperature curves.

As previously mentioned, the self-testing method is characterized in particular in that temperature measurements can be made by the temperature sensors already installed in the cooking appliance, as a result of which the functionality of specific actuators can be checked. The self-testing method according to the invention is based on the principle of evaluating specific rates of temperature change. For this purpose, reference is made to FIGS. 19 and 20, which show time-dependent temperature curves in idealized, graphic form. FIG. 19 shows three temperature curves 53, 54, and 55, wherein the temperatures are intended to move between a temperature $T_{Start}$ and a temperature $T_{Nominal}$. Curve 53 shows the change in temperature observed when the heating device is functioning correctly. Thus, starting at time $t_0$, the nominal temperature $T_{Nominal}$ is reached within a predetermined time interval ending at $t_1$. The time interval can be, for example, 60 seconds. Curve 54 does not reach the desired nominal temperature $T_{Nominal}$ until time $t_2$, which corresponds to twice the value of $t_1$, i.e., 120 seconds in this example. As a result, it can be established that either one phase of the electrical circuit or a heating element has failed. If a change in temperature like that shown by curve 55 is observed, then it can be concluded that the heating device has failed.

Figure 20:
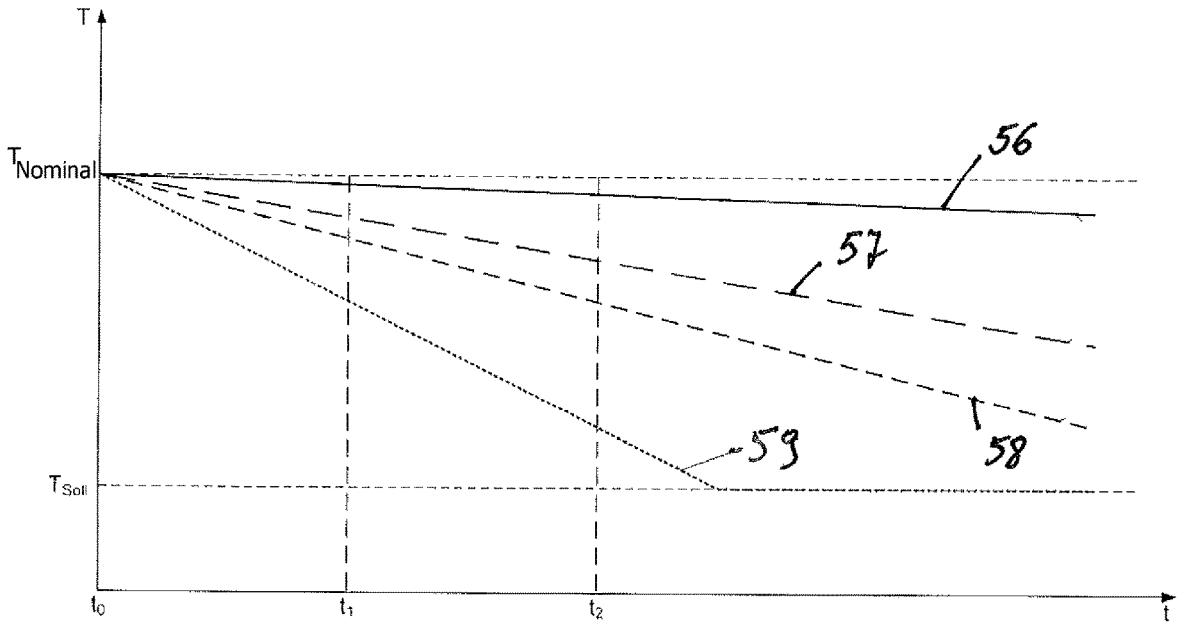
FIG. 20 shows an idealized graph of the drop in temperature along four curves, each dependent on one of the working actuators.

FIG. 20 shows idealized temperature drop curves 56, 57, 58, and 59, which lead from a starting temperature value $T_{Start}$, to a lower temperature value $T_{Nominal}$. Curve 56 shows the normal temperature drop observed when the heating device is turned off, e.g., 2 degrees Kelvin in 60 seconds. During active generation of vapors, curve 57 is expected, corresponding to −10 degrees Kelvin in 60 seconds.

The expected temperature drop during active dehumidification is illustrated by curve 58, corresponding to −15 degrees Kelvin in 60 seconds, for example.

The fastest temperature drop is expected when the recirculation pump is running, namely, a drop of −15 degrees Kelvin in 30 seconds according to curve 59. If the drain pump is active and the recirculation pump is also running, however, the normal change in temperature shown by curve 56 is expected. In the case of a defect, namely, a defective drain pump, the temperature would change in the manner shown by curve 59.

The evaluation depends, among other things, on the size of the appliance, on the type of energy and type of voltage, or on the type of gas. Thus appliance-dependent limit values are obtained. The temperature measurements are intended to confirm or rule out appliance defects.

It is advantageous for the self-testing method to be used as part of the final inspection of the appliance before it is delivered to the customer. This situation will be referred to first.

The self-testing method of the present invention comprises two areas; the compartment internal climate (temperature/humidity) control of the cooking appliance and the cleaning of the cooking appliance.

The advantageous possibility is available to conduct the two tests either separately or together as a complete test. The complete test saves a corresponding amount of time, wherein the climate (temperature/humidity) test can be conducted without the need for any further preparation. In contrast, when a complete test is to be run or when only the cleaning test is to be run, it is necessary to make certain preparations first.

The following actuators can be evaluated by the self-testing method:

I. Climate (Temperature/Humidity) Control:

1. heating device, chain of solid-state relays (SSRs), heating element, wiring, failure of one phase or of a heating circuit;
2. temperature control and interaction between controller, sensor, heating element or gas burner fittings and gas heater;
3. steam injection/generation assembly;
4. dehumidifying device, especially the feed air flap.

II. Cleaning:

1. reed contact of the cooking appliance door;
2. recirculation pump;
3. drain pump;
4. steam or vapors quenching valve.

The self-testing method according to the invention is limited to the actuators which are not automatically checked during normal operation. These actuators are:

the circulating air blower: error messages over the CAN bus, for example;

gas ignition box and gas blower: error messages via MicroCom, for example;

temperature sensors: sensor breakage detection; and components such as the main fuse.

It is advantageous for the self-testing method to be turned off on the basis of a certain parameter; this corresponds to a blocking of certain users from conducting the self-testing method, depending on the concrete application desired. The self-testing method can thus be reserved solely for remote diagnosis. All times and temperatures are to be taken from an Excel table, which is stored in internal memory or in an XML file. According to the present invention, the following table is obtained by way of example:

| Component | Test | Target Value |
|---|---|---|
| Heater | Time (s) to heat from 50° C. to 90° C. | T = 60 s |
| Steam injector | ΔT after 1 minute | Δt = 10 K |
| Dehumidifier | ΔT after 1 minute | Δt = 15 K |
| Recirculation pump | ΔT after 30 s | Δt = 15 K |
| Vapors quenching valve | ΔT after 20 s | Δt = 10 K |
| Drain pump | Temperature in ° C. after 90 s | T = 130° C. |
| Temperature controller | Temperature in ° C. after 5 min | T = 140 |

Figure 4:
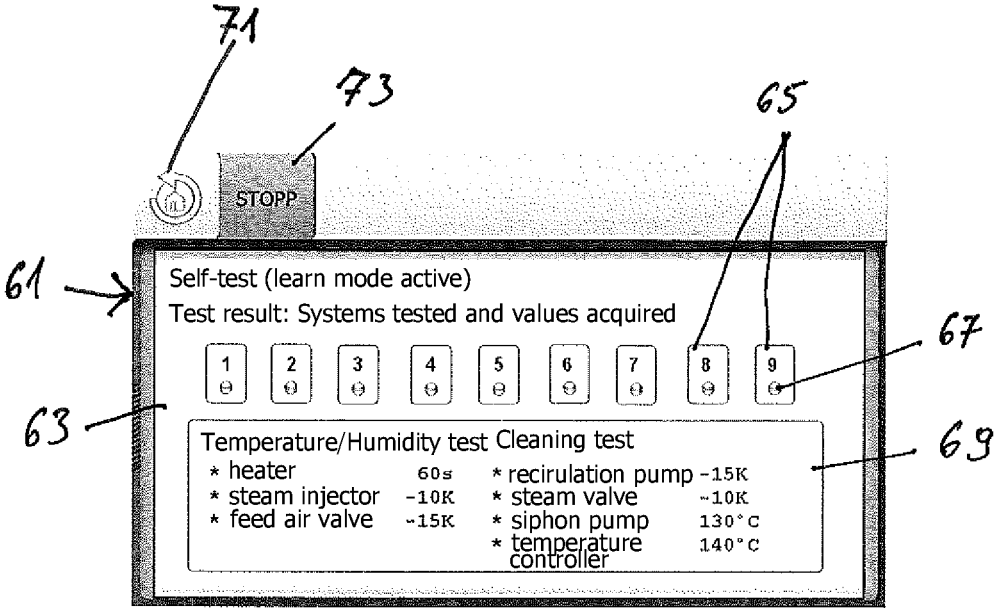
FIG. 4 shows a "self-test" display field with indication of the actuators being checked during the "Temperature/Humidity Test" and the "Cleaning Test"

If an appliance is tested for which no values have yet been defined, the self-test can be started in a special mode. For this purpose, the selection is displayed accordingly on the display panel 17, as shown in FIG. 4. In the display panel, a display and control field 61 appears; this includes a display section 63, which comprises display fields 65 with the numbers 1-9 representing the individual test steps or actuators. In each display field 65, an indicator light 67 is provided, which lights up green if the test or test step has been successful or red if the test has been failed. A display field 69 is provided, which shows the current status. The test can be started, terminated, or interrupted by the use of the input field 73. A "go-back" field 71 can be used to set the program or the test step back. Fields 71 and 73 can also be displayed in the same or a similar manner in association with all of the various types of inputs, including those used for the cooking programs, for example.

During learn mode, the selected test will not be stopped but will instead run to completion. The following temperature profiles are determined:

Climate (Temperature/Humidity) Test:

heating, duration in seconds for heating from 50° C. to 90° C.;

steam generation/injection, temperature drop in degrees Kelvin after one minute;

dehumidification (feed air flap open), temperature drop in degrees Kelvin after one minute.

Cleaning Test:

recirculation pump, temperature drop in degrees Kelvin after 30 seconds;

vapors/steam quenching valve, temperature drop in degrees Kelvin after 20 seconds;

drain pump, temperature in ° C. after 90 seconds.

The expected values for the specific appliance in question are stored in a file (e.g., an XML file), which is automatically overwritten during the execution of learn mode. Thus even customized machines can be easily provided with the expected values. This file is not overwritten when an update occurs.

If, at the start of the self-test, the appliance-specific file is not yet present, the corresponding values are read from the central file and written to the appliance-specific file. In the central file, the values are stored for all current models and can be selected automatically on the basis of the combination of appliance model and type of heating device. It is possible for this file to be overwritten when an update occurs.

Figure 5:
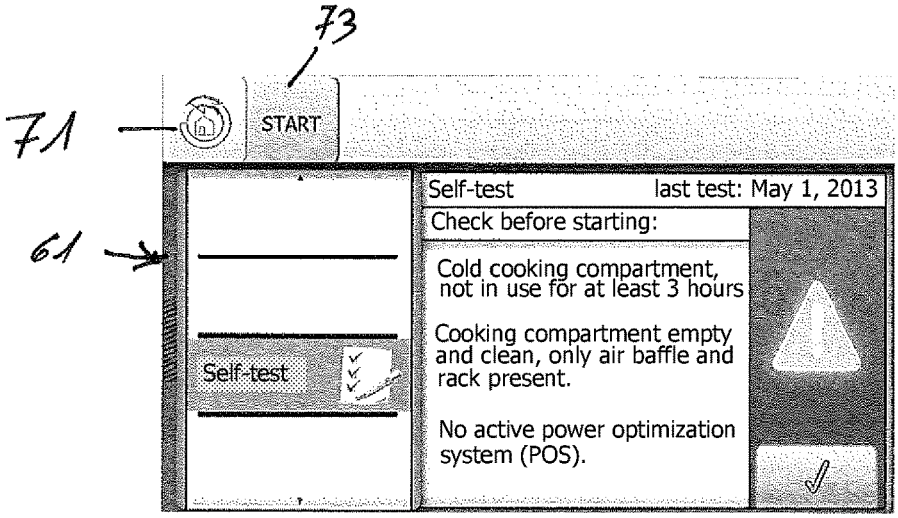
FIG. 5 shows a display and control field with instructions about the conditions which must be present before the test starts.
Figure 6:
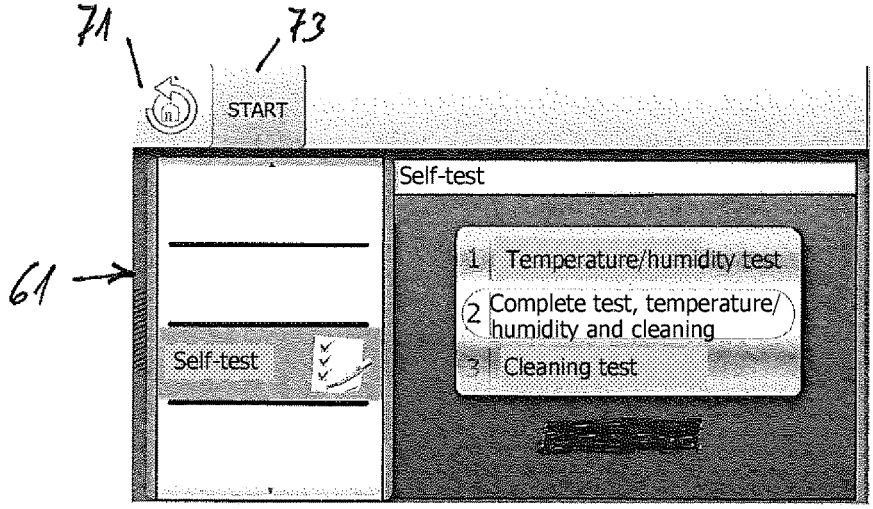
FIG. 6 shows a display and control field with three possible tests, where test no. 2, "Complete Test of Temperature/Humidity and Cleaning", has been selected.

The test sequence is described below. Cooking appliance 1 is in a starting state:

1. Cold cooking compartment, not in operation for at least three hours.
2. Cooking compartment empty and clean, only air baffle and hook-in rack present.
3. Door is closed.
4. No external power optimization system (POS) is active. If the power optimization system is connected, it must be bridged in software, because otherwise a malfunction will result during the "appliance power test". The POS transmits a signal to the cooking appliance when it is not supposed to draw power. This signal can usually be bridged in software, because the POS does not bring about an electrical separation.
5. Steam/vapors quenching is to be deactivated.
6. Safety mechanisms which prevent the test from running in its entirety are to be deactivated. Selecting the self-test from the service menu causes the display shown in FIG. 5 to appear. Touching the input field 73 starts the test. FIG. 6 then shows the choices; in the example shown, choice no. 2, "Complete Test: Climate (temperature/humidity) and Cleaning" is highlighted.

The appliance can be tested completely in about 25 minutes by the automatic test procedure. The results and the date of the most recent preceding self-test are displayed. Alternatively, the test can be started over a network connection (ethernet, see below). The test of the door, i.e., of the door's reed contact, must be carried out beforehand.

After the test has been started, the appliance first checks to determine whether the following temperatures are under 50° C.: cooking compartment temperature, core temperature sensor, possibly the humidity sensor. If this temperature is exceeded, the test program is stopped, and the error message "appliance too hot" is displayed. If the temperatures are in the desired range, the test begins.

Figure 7:
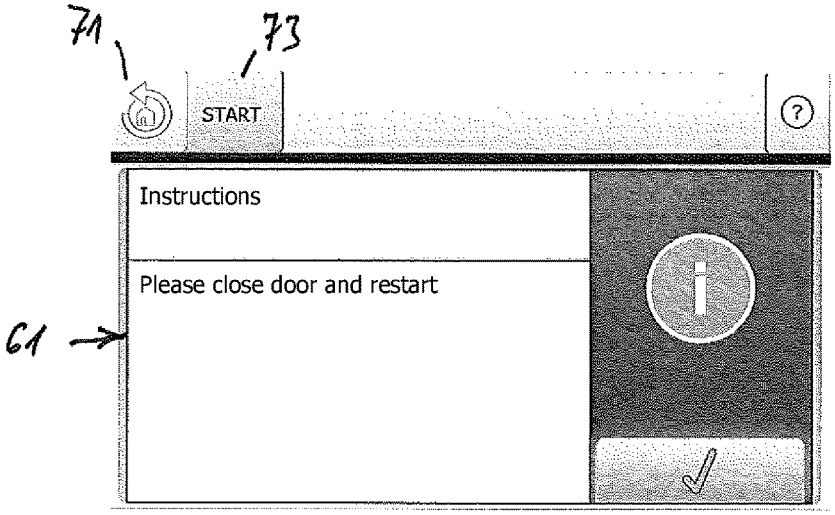
FIG. 7 shows a display and control field with the instruction to close the door before starting the test.

The appliance is preferably operated at all times so that the blower turns only in one direction (e.g., always toward the right) and at the "fast" speed setting. All of the tests proceed in sequence. As shown in FIG. 7, the user is instructed first to close cooking compartment door 7 and then to start the program. If, however, the door is opened again in a later step after the door contact has been checked, the test is stopped and a corresponding message is shown: "door was opened, test stopped". In a case such as this, it is preferable to repeat the entire test.

Figure 8:
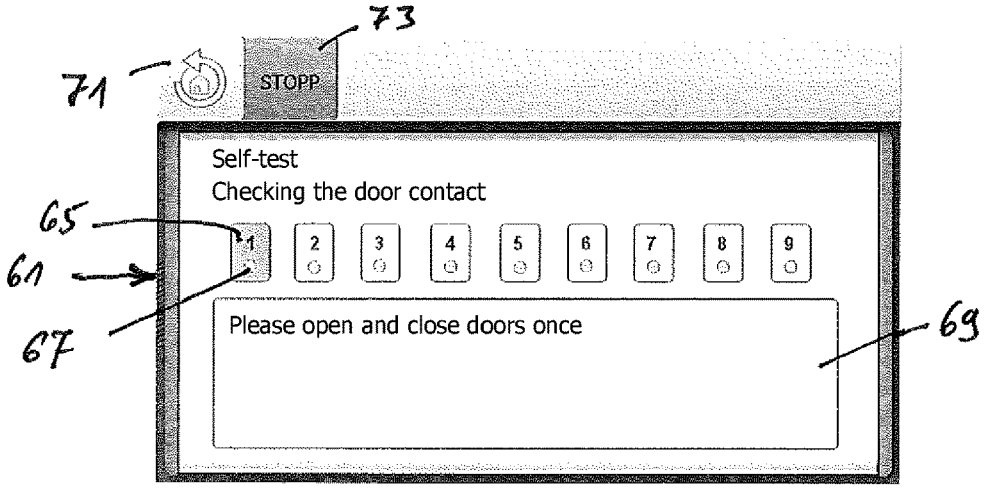
FIG. 8 shows a display and control field for checking the door contact.

FIG. 8 shows the beginning of the self-testing or program step as indicated by the first field 65, highlighted in color, so that the operator knows which test or which step is being conducted. If the test or program step is successful, the indicator light 67 lights up green.

Most of the tests should be conducted in "convection mode", because this advantageously prevents steam from being injected, which would falsify the test results.

The cooking appliance shown in FIGS. 1-3 comprises a cooking compartment 6. The self-testing method according to the invention, however, is also adapted to so-called twin-compartment appliances, i.e., cooking appliances with two compartments with all the fittings, arranged one above the other, wherein the cooking compartments are not separated but rather form a single compartment. Both compartments are operated at all times, and the test also takes place in both compartments simultaneously. The temperature measurement is carried out simultaneously for the individual compartments; i.e., a mean value is not acquired.

Door 7 must be closed before the self-test can begin. If door 7 is not closed, the test will not start, because if it is open it is impossible to detect a defect in the door contact reliably. Instead, a message is shown, as can be seen in FIG. 7, "Please close the door and start again". The function of the door contact must be ensured in order to allow the self-testing method to proceed. To fulfill this test requirement, the user must open the door and close it again within a predetermined time interval, such as 60 seconds, which he is instructed to do as shown in FIG. 8. If the test is started over a network connection, the door must be checked to make sure it is closed.

After door 7 has been closed, the display according to FIG. 8 fades out, and then, depending on the previous selection, the next display appears.

The test of door 7 contact lasts until the signal "door closed" has been received for at least two seconds. This ensures that the door is properly latched. The present invention proposes that, if the door is not opened and closed again within the predetermined period, it is concluded that the door contact has failed the test. The complete self-test is terminated, and the corresponding results are displayed.

Figure 9:
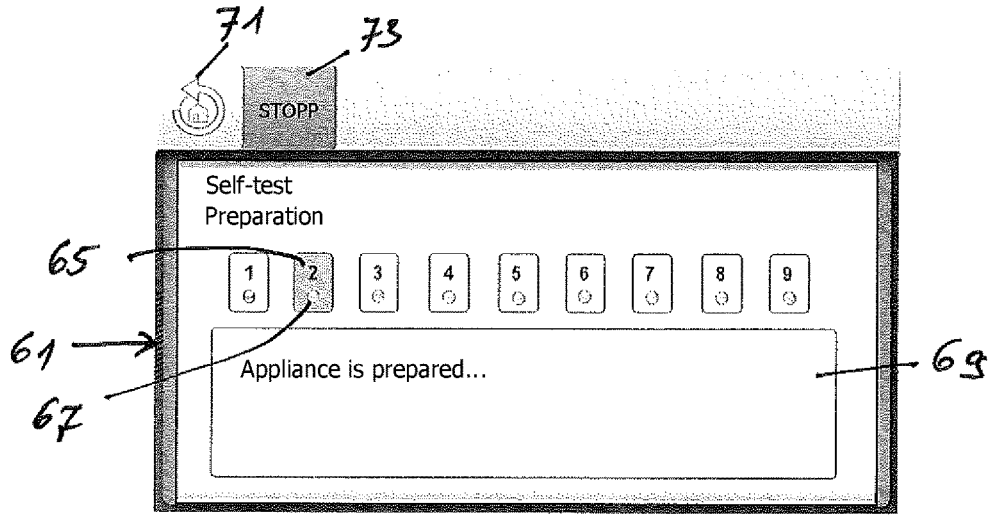
FIG. 9 shows a display and control field for "Preparation"

To conduct the individual actuator tests, it is necessary to prepare the cooking appliance, i.e., to establish a predefined initial state, as shown in field 69 of FIG. 9, in which all the relevant information appears. This preparation comprises the cleaning of the siphon or liquid reservoir of the cleaning circuit system present in cooking appliances of this type. This is necessary, because the content of the liquid reservoir is conveyed later into the cooking compartment. Nevertheless, this preparation is necessary only if the operator has selected "Complete Test" or "Cleaning Test". The preparation which FIG. 9 requires is carried out by turning the drain pump on for 20 seconds, for example, and then by turning the steam/vapors quenching valve on for 20 seconds. This sequence is repeated once or several times as needed.

Figure 10:
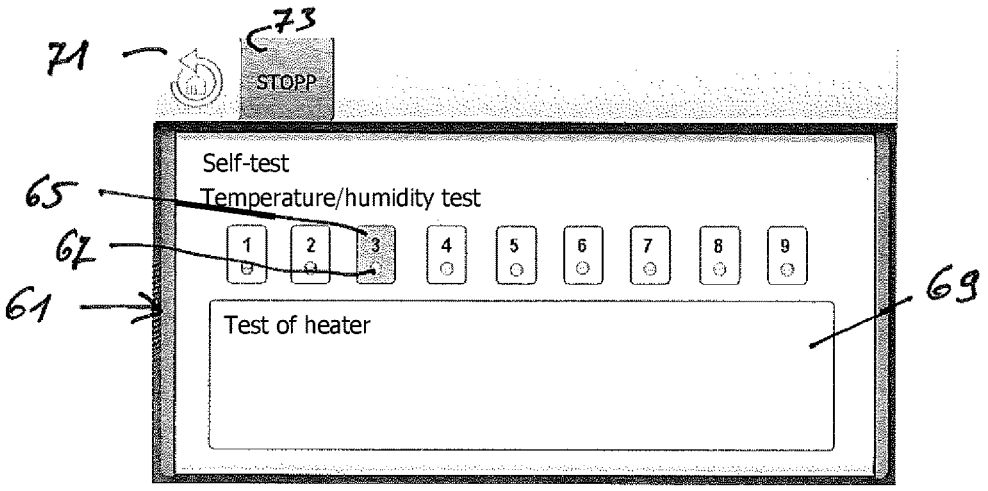
FIG. 10 shows a display and control field for the "Heating Test"

The Complete Test now begins in step 3, as can be seen in FIG. 10, with the test of the heating power. For example, the appliance is heated for three minutes at a setting of 95° C. "Convection" mode is selected, and the blower mode "always to the right" is set. Now the time is determined which it takes for the cooking compartment temperature, as measured by the temperature sensor 35, to rise from 50° C. to 90° C. The nominal time, such as, 60 seconds+10 seconds/−20 seconds, is stored in the cooking appliance. If one of the phases is missing, for example, the time required will be 120 seconds, as can be seen in FIG. 19.

The test can thus reliably determine whether or not:

one of the phases is missing, as a result of which only half the heating power is available (twice the heating time). It can also be determined whether or not one of the two solid state relays is defective (longer heating time) or both are defective (appliance does not heat up at all);

an external or internal fuse is defective;

one or more of the heating elements are defective.

Figure 11:
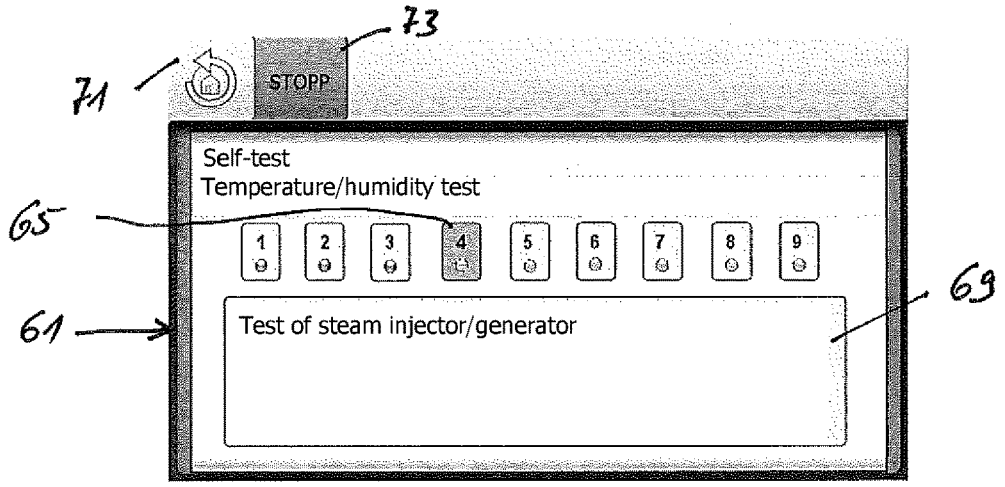
FIG. 11 shows a display and control field for the "Steam Injection/Generation Test"

Then, as part of the climate (temperature/humidity) test, the self-testing method continues with the test of the steam generator/injector, as shown in FIG. 11. The appliance is held at the temperature of the preceding test for 4 minutes, for example. This has the effect of testing the temperature controller in the lower temperature window The actual temperature must lie within the limits of 95° C.±3 K, and the temperature in the cooking compartment must be kept stable. Then the nominal value is lowered to 30° C. Now the steam injection/vapors generation is activated. A sufficiently large temperature drop must then be measured. The temperature must, for example, drop by 10 K+10 K or −2 K within 60 seconds. If the steam injection/vapors generation does not function, the drop will be only 2 K in 60 seconds, as can be seen from curve 56 in FIG. 20.

Figure 12:
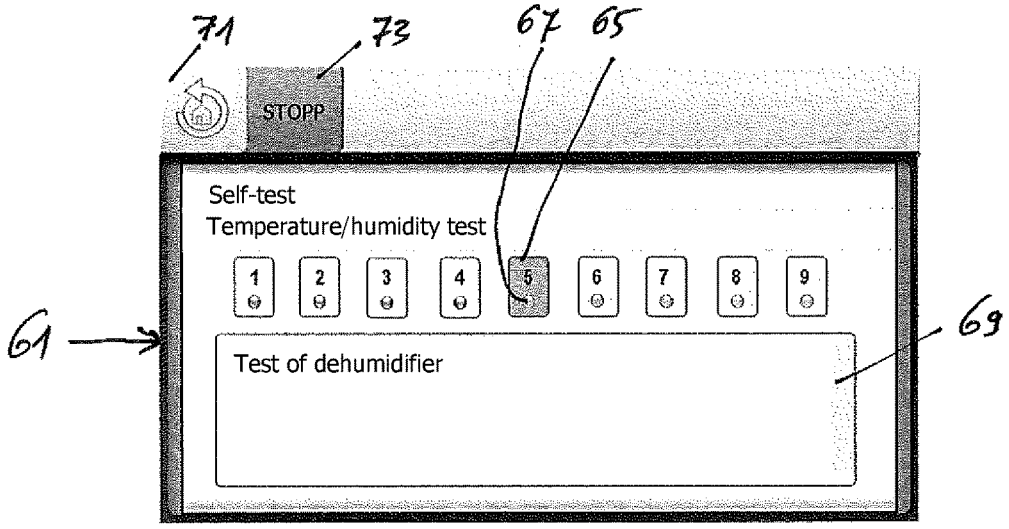
FIG. 12 shows a display and control field for the "Dehumidification Test"

To test the dehumidifier, as shown in FIG. 12, in particular to test the feed air flap, the nominal temperature is set down to, for example, 30° C. after the heater has been turned off. As a result of the previous test, the humidity sensor, if present, will already have been heated, so that the feed air flap can be opened right at the beginning of the test The temperature of the humidity sensor must drop faster than it does during a cooling phase without dehumidification; for example, it must drop by at least 15 K+10 K/−5 K in 60 seconds. If the drop is less than that, the feed air flap is defective If the values deviate slightly, it can be concluded that the feed air flap is clogged or blocked.

The test of the feed air flap concludes the climate (temperature/humidity) test.

The cleaning test can now be carried out immediately thereafter, or, as previously mentioned, it can also be carried out separately.

Figure 13:
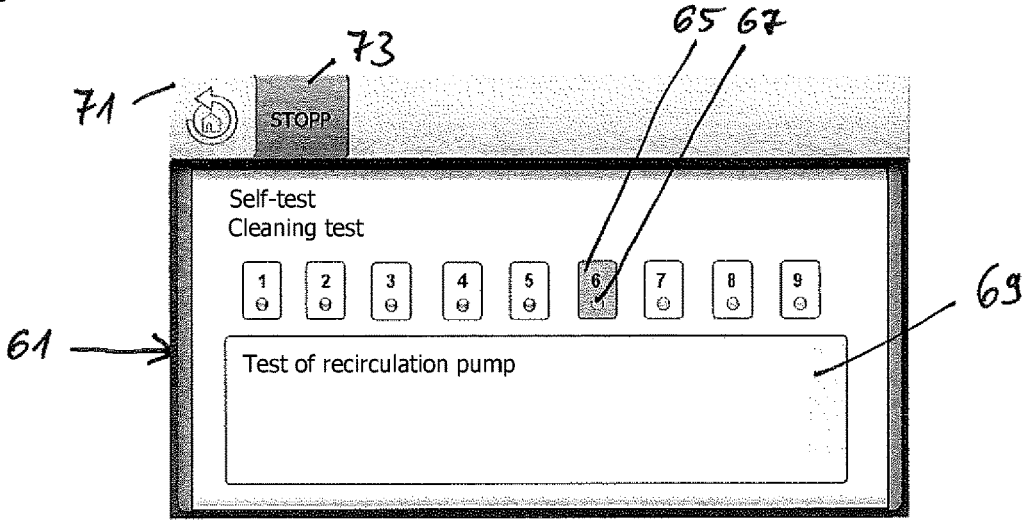
FIG. 13 shows a display and control field for the "Recirculation Pump Test"

As shown in FIG. 13, the recirculation pump 49 is tested first, for example. The appliance is operated in "convection" mode at 90° C. for three minutes, for example. The heater is turned off and the nominal temperature lowered to 30° C. Then the recirculation pump 49 is activated for 30 seconds. The cooking compartment temperature must drop by 15 K +10 K/−5 K. If the temperature drop is less than that, as illustrated by curve 59 in FIG. 20, the recirculation pump is defective. After 30 seconds, for example, the staem/vapors quenching valve 47 is opened for 10 seconds to fill the liquid reservoir. A small deviation from the expected temperature curves can also be evidence of, for example, a partially clogged pump.

Figure 14:
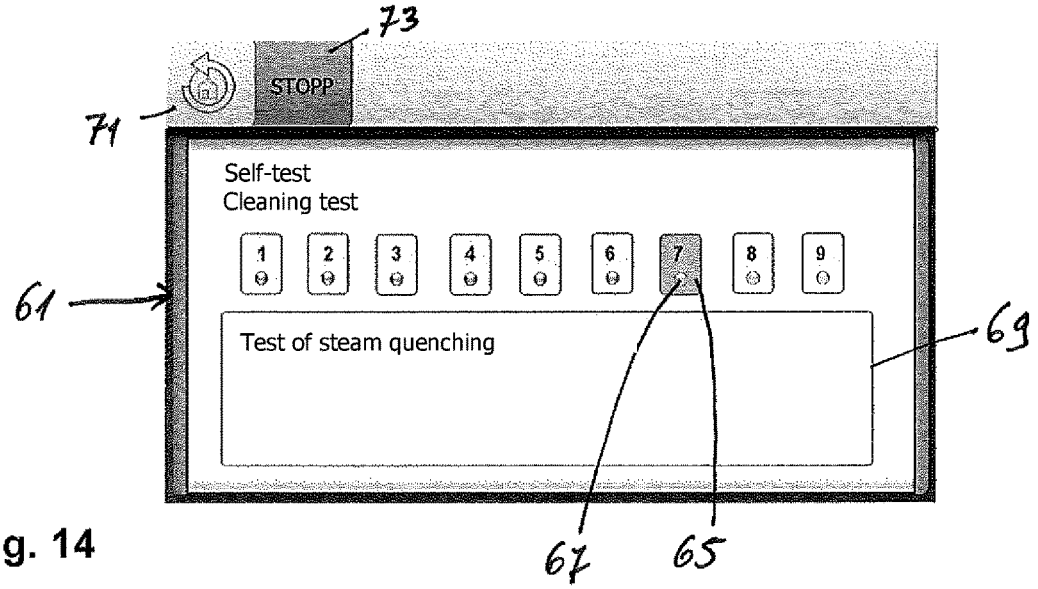
FIG. 14 shows a display and control field for the "Steam Quenching Test"
Figure 15:
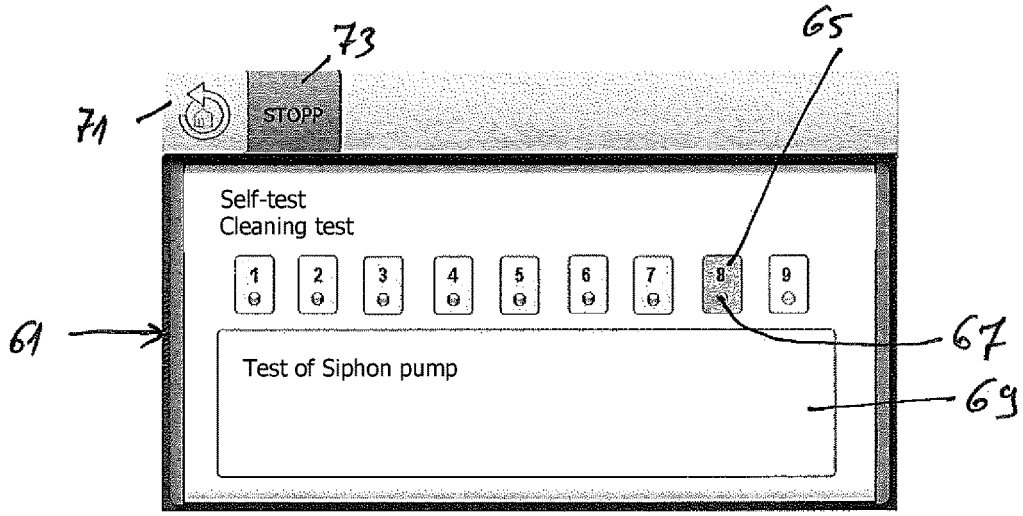
FIG. 15 shows a display and control field for the "Drain Pump Test", also called here the "Siphon Pump Test"

Then the test of the steam valve, i.e., of the steam/vapors quenching valve 47, is carried out, as shown in FIG. 14. The nominal temperature is set at 90° C., and heating is carried out for essentially 2 minutes. Then the cooking program is stopped for, for example, 30 seconds (waiting time) . The steam/vapors quenching valve 47 is activated for about 20 seconds. The steam/vapors temperature must drop by 10 K+10 K/−5 K within the open time of the steam/vapors quenching valve of 20 seconds. If this temperature drop is not observed, the steam/vapors quenching valve is defective.

In the cleaning test, the next step is the testing of the siphon or drain pump 51. First, the drain pump 51 is turned on for about 20 seconds to empty the liquid reservoir. Then the cooking appliance is operated for about 2 minutes 30 seconds at 130° C. in convection mode, wherein the blower wheel 29 is operated continuously toward the right. The recirculation pump 49 is turned on during the heating phase. Within the operating time in convection mode, the appliance must reach a cooking compartment temperature of 130° C.+10 K/−5 K. If this not reached, the drain pump 51 is defective. The reason for this is that, while liquid is being circulated, it is not possible for the temperature in the cooking compartment to rise much above 100° C. (temperature at which water evaporates). An increase does not occur until after the water has evaporated; that is, until after the drain pump 51 has emptied the liquid reservoir. The liquid reservoir is now filled up again, which is done by first turning off the recirculation pump 49 and only then turning on the steam/vapors quenching valve 47 for essentially 20 seconds. In the case of higher-power appliances, the test is carried out at reduced power to avoid evaporating the water completely.

Figure 16:
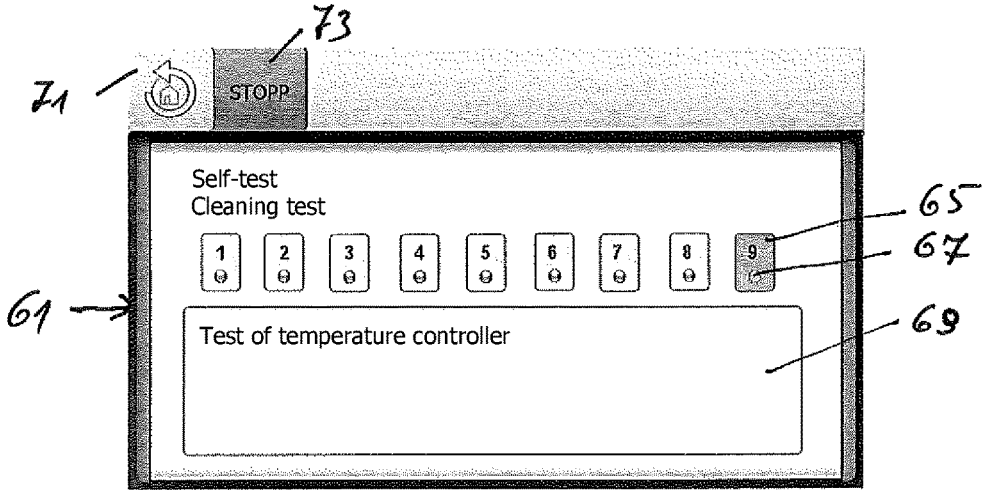
FIG. 16 shows a display and control field for the "Temperature Control" test.

If necessary, the temperature controller can be tested again as shown in FIG. 16, wherein convection mode (blower turning continuously to the right), at a setting of 140° C., is carried out for 5 minutes. The cooking compartment temperature must be in the range of 140° C.+/−3 K in the last two minutes.

The tolerances given above are cited merely as examples and can be different within the scope of the invention.

Figure 17:
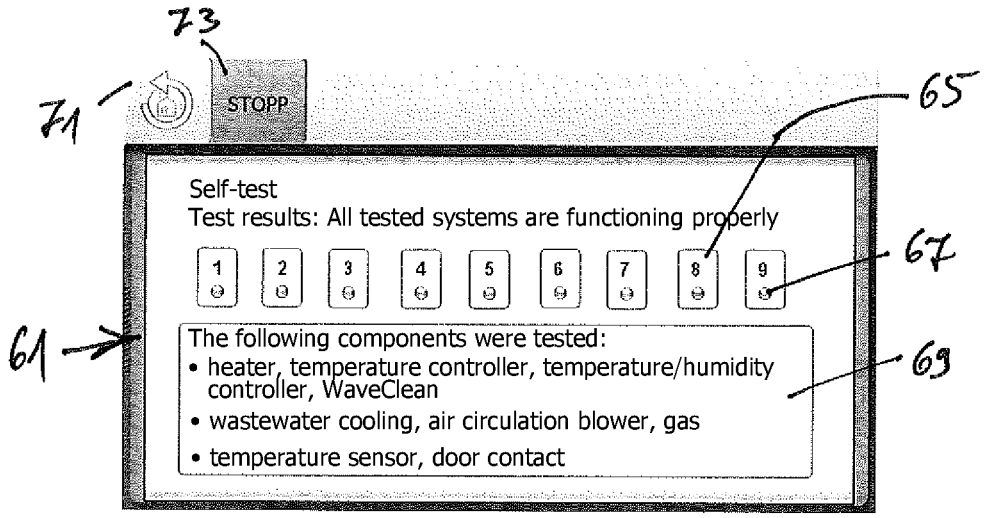
FIG. 17 shows a display and control field with the test results, which do not include an error message.

Fields 65 and 69 of FIG. 17 show the test evaluation, wherein it is indicated which components were tested. All of the indicator lights 67 are green.

Figure 18:
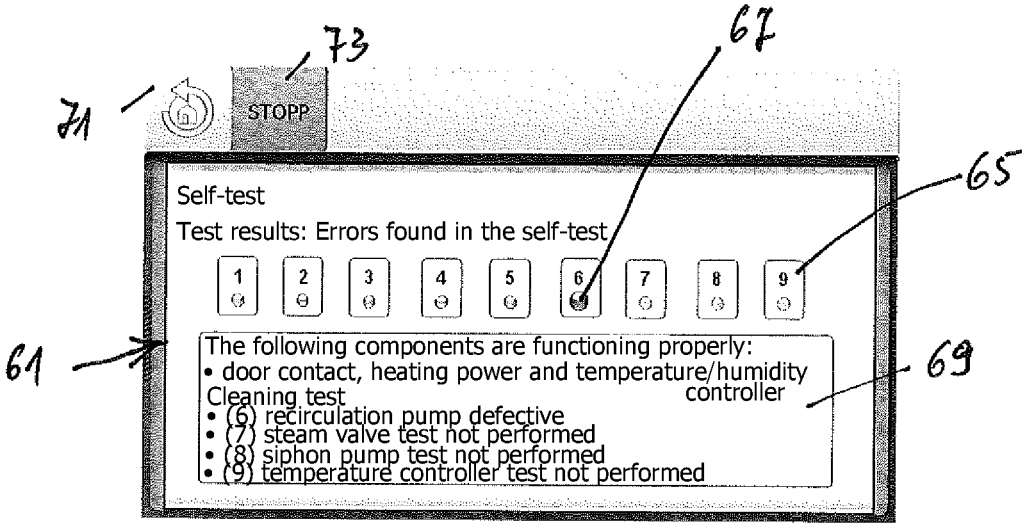
FIG. 18 shows a display and control field with the test results, which include an error message concerning the recirculation pump.

If, however, it has been discovered that a test was failed, as, for example, the test of recirculation pump 49, then, as shown in FIG. 18, the indicator light 67 for cleaning test no. 6 will light up red. The appropriate information is given in field 69.

The following table shows the dependence of the malfunctions of the individual components on other components.

| Component | Dependence |
|---|---|
| Door contact | -- none -- |
| Heating power | Blower, door contact |
| Steam injector | Blower, heating power, door contact |
| Dehumidifier | Blower, heating power, door contact |
| Recirculation pump | Blower, heating power, door contact |
| Steam quenching valve | Blower, heating power, door contact, recirculation pump |
| Drain pump | Blower, heating power, door contact, recirculation pump |
| Controller, upper temperature window | Blower, heating power, door contact |

The functionality test of blower 29 can be checked on the basis of, for example, significant temperature differences in the cooking compartment. For example, this can be done by comparing the measurement values of cooking compartment sensor 35 with those of the core temperature sensor (not shown). If the door contact or the heater are not working properly, the test is stopped, because the other tests will not work.

If the test of recirculation pump 49 is negative, the result for steam injection valve 47 and drain pump 51 will not be evaluated, or these two tests will not be performed. A record will be kept, however, of the test result.

According to the present invention, the self-testing procedure can be started in the form of a remote diagnosis. For this purpose, a wired or wireless connection to the cooking appliance can be used. In particular, this self-test can be initiated over an ethernet connection. For this purpose, for example, the protocol for the kitchen process control system can be used. By means of an additional command and an action number, the self-test can be started, stopped, or evaluated.

| Action | Description |
|---|---|
| 1 | Start complete test. |
| 2 | Start complete test of a new appliance. |
| 3 | Start temperature/humidity test. |
| 4 | Start cleaning test. |
| 5 | Stop/interrupt self-test. |
| 6 | Determine current status. |
| 7 | Results of the self-test. |
| 8 | Self-test data of the new appliance. |

With the present invention, the possibility of self-testing a cooking appliance in the form of a convection oven, a steamer, or a combination of the two, namely, convection steamer, is created, which takes place essentially automatically and by means of which all of the essential actuators of the cooking appliance can be automatically checked in a short time, as a result of which the functionality of the cooking appliance can be displayed to the operating personnel and/or any malfunctions and defects can also be displayed. There also exists the possibility—especially relevant to customer service personnel—to gain remote access to the appliance, which may be installed a considerable distance away, and to learn from the self-test which components of the cooking appliance are possibly defective. This helps them to provide the necessary spare parts in an efficient manner.

The self-testing methods can also be used to test new appliances and to calibrate them, which prevents partially defective appliances from being delivered to customers.

The present invention is not limited to the exemplary embodiments described here In particular, the numerical values which are cited are given only by way of example, and deviations from them are also within the scope of the invention.

The invention claimed is:

1. A method for self-testing and checking functions of a cooking appliance comprising the steps of:

providing a steamer, or a combination of a convection oven and a steamer, the steamer being a convection steamer, which each comprises a cooking chamber or compartment which can be closed by a cooking compartment door, a plurality of actuators, the actuators being pumps, at least one heating device, at least one steam injection/generating device, at least one flow-generating device, the at least one flow-generating device being a blower, at least one dehumidifier, and flaps and/or valves as well as comprising temperature sensors and an appliance control unit;

wherein the functionality of the actuators of the cooking appliance can be checked by the temperature sensors of the cooking appliance in that detected temperatures and temperature profiles are compared with reference temperature values or reference temperature profiles which are to be expected during operation of the actuator in question, and which are stored in an electronic appliance control unit;

comparing the detected value with the corresponding reference value;

concluding by the appliance control unit that the actuator in question is functioning properly, or, if a deviation is detected, that it is malfunctioning and displaying, storing, and/or transmitting the results for evaluation, wherein at the beginning of each detection, the cooking appliance is in a defined initial state, such that at least two actuators can be checked in succession, the defined initial state of the at least second actuator test is produced by the preceding actuator test, and wherein the heating device is checked within the scope of the self-test as the first actuator;

verifying within the scope of the self-test as a further actuator a recirculation pump for only cleaning of the cooking chamber compartment, the recirculation pump being configured for automatically circulating only cleaning liquid for cleaning of the cooking chamber compartment and additionally at least one of the following actuators of the cooking appliance: steam injector/generator, dehumidifier, drain pump for emptying a liquid reservoir; and determining the functionality through a functionality test of the recirculation pump of a cleaning system in that, after the cooking compartment has been heated and the recirculation pump has been turned on for cleaning, the cooking compartment temperature during the functionality testing drops by a predetermined amount in a predetermined time interval;

wherein a long-distance service is carried out on the cooking appliance and wherein steam is only used for cooking and the recirculation pump is only used to circulate cleaning liquid.

2. The method of claim 1 wherein a temperature and/or humidity control and the cleaning of the cooking appliance can be checked by the self-test.

3. The method of claim 1 wherein the temperature control is checked in that convection mode, at a setting of 140° C., is carried out for 5 minutes, wherein the cooking compartment temperature must be in the range of 140° C.+/−3 Kelvin in the last two minutes.

4. The method of claim 1 wherein the functionality of the dehumidification by a dehumidifier is determined in that, after the cooking compartment has been heated and the dehumidification device has been opened, the temperature of a sensor thermally coupled to the dehumidification device, the sensor being in a feed air pipe, drops by a predetermined amount in a predetermined time interval.

5. The method of claim 1 wherein the functionality of the steam injector/generator is determined such that after the heating device has been heated to a predetermined temperature, the temperature drop under active steam injection/generation is detected.

6. The method of claim 1 wherein the functionality of the drain pump is determined in that, with the liquid reservoir full to start and the recirculation pump running, the drain pump is turned on and the cooking appliance is heated up in convection mode, whereupon a temperature greater than 100° C. is observed after a predetermined time interval.

7. The method of claim 1 wherein a sealing effect of the door seal is determined in that, after the cooking compartment has been heated to a predetermined temperature, the door is kept closed and the temperature drop is detected after the heating device has been turned off and the actuators deactivated.

8. The method of claim 1 wherein the cooking appliance is used for self-testing of a new appliance.

9. The method of claim 8 wherein the detected values are stored for later checking in a values table.

10. The method of claim 1 wherein the cooking appliance is started over a wired or wireless connection connected to the cooking appliance.

11. The method of claim 1 wherein the individual self-tests proceed automatically, and such results are displayed, transmitted and/or stored as data.

12. A cooking appliance in the form of a convection oven, a steamer, or a combination of the two, namely, a convection steamer, which comprises a cooking chamber or compartment, which can be closed by a cooking compartment door, a plurality of actuators such as pumps, at least one heating device, at least one steam injection/generating device, at least one flow-generating device, and flaps and/or valves as well as temperature sensors and an electronic appliance control unit, the cooking appliance being adapted to, and capable of, carrying out a self-testing method including through the use of the temperature sensors of the cooking appliance, the functionality of the actuators of the cooking appliance can be checked in that the detected temperatures and temperature profiles are compared with the reference temperature values or reference temperature profiles which are to be expected during operation of the actuator in question, and which are stored in the electronic appliance control unit, and, if the detected value agrees with the corresponding reference value, the appliance control unit concludes that the actuator in question is functioning properly, or, if a deviation is detected, that it is malfunctioning and displays, stores, and/or transmits the results for evaluation, wherein the cooking appliance begins the checking procedure only if it is in a defined initial state at the beginning of each detection, wherein at least two actuators are checked in succession, and wherein the defined initial state of the at least second actuator test is produced essentially by the preceding actuator test, and wherein the cooking appliance is able to check the heating device within the scope of the self-test, wherein within the scope of the self-test, the cooking appliance checks at least one of the following actuators: temperature controller, steam injector/generator, dehumidifier, recirculation pump, drain pump for emptying a liquid reservoir, and the cooking appliance determines the functionality of the steam injector/generator in that, after the heating compartment has been heated to predetermined temperature, the temperature drop under active steam injection/generation is detected.

* * * * *